US010207886B2

(12) United States Patent
Pryle et al.

(10) Patent No.: US 10,207,886 B2
(45) Date of Patent: Feb. 19, 2019

(54) WINDER AND A TURRET UNIT

(75) Inventors: Richard David Pryle, Bedford (GB); Carlos Martinez, Altendorf (CH); Rolf Kammann, Westerkappeln (DE); Frank Hoffmann, Greven (DE)

(73) Assignees: Swiss Winding Inventing AG, Pfäffikon (CH); Windmöller & Hölscher KG, Lengerich (DE)

( * ) Notice: Subject to any disclaimer, the term of this patent is extended or adjusted under 35 U.S.C. 154(b) by 52 days.

(21) Appl. No.: 14/130,030

(22) PCT Filed: Jul. 4, 2012

(86) PCT No.: PCT/CH2012/000154

§ 371 (c)(1),
(2), (4) Date: Dec. 12, 2014

(87) PCT Pub. No.: WO2013/003968

PCT Pub. Date: Jan. 10, 2013

(65) Prior Publication Data

US 2015/0122934 A1 May 7, 2015

(30) Foreign Application Priority Data

Jul. 5, 2011 (CH) ..... 1122/11

(51) Int. Cl.
*B65H 19/22* (2006.01)
*B65H 19/30* (2006.01)

(52) U.S. Cl.
CPC ..... *B65H 19/2223* (2013.01); *B65H 19/30* (2013.01); *B65H 2301/418* (2013.01);
(Continued)

(58) Field of Classification Search
CPC ..... B65H 2301/4148; B65H 19/2215; B65H 2301/41362; B65H 2301/41818;
(Continued)

(56) References Cited

U.S. PATENT DOCUMENTS 2,361,795 A * 10/1944 Roesen ..... B65H 19/2253
242/527.3
2,703,681 A * 3/1955 Jacobs ..... B65H 19/1821
242/555.5

(Continued)

FOREIGN PATENT DOCUMENTS

DE 4116964 A1 11/1992
DE 19609802 A1 9/1997

(Continued)

OTHER PUBLICATIONS

Cescutti, Gabriel, "International Search Report" for PCT/CH2012/000154, dated Jan. 16, 2013, 10 pages.

*Primary Examiner* — Michael E Gallion
(74) *Attorney, Agent, or Firm* — Winstead PC

(57) ABSTRACT

Winder for an endless lane of a plastic web (2), with a revolving unit (6, 6', 55, 90), which is constructed so as to be rotatable about its axis (16) and has at least two winding shafts (10 to 12, 10' to 12') running parallel to its axis, onto which winding cores (17) can be loaded, then wound with the web (2) to a roll (18), finally unloaded therefrom again as finished rolls (18), wherein on both sides of the revolving unit (6, 6', 50, 90) support arrangements are arranged, in which the winding shafts (10 to 12, 10' to 12') are supported at their corresponding ends therein, and wherein the support for one end of the winding shafts (10 to 12, 10' to 12') is constructed so as to be detachable, such that the respective winding shaft (10 to 12, 10' to 12'), with released support, can be loaded and unloaded from this end, characterized in that the detachably constructed support arrangements each have a gripper arrangement (36 to 38) with a two-armed scissor unit (39 to 41), the scissor arms (42, 43) of which
(Continued)

Figure 1:
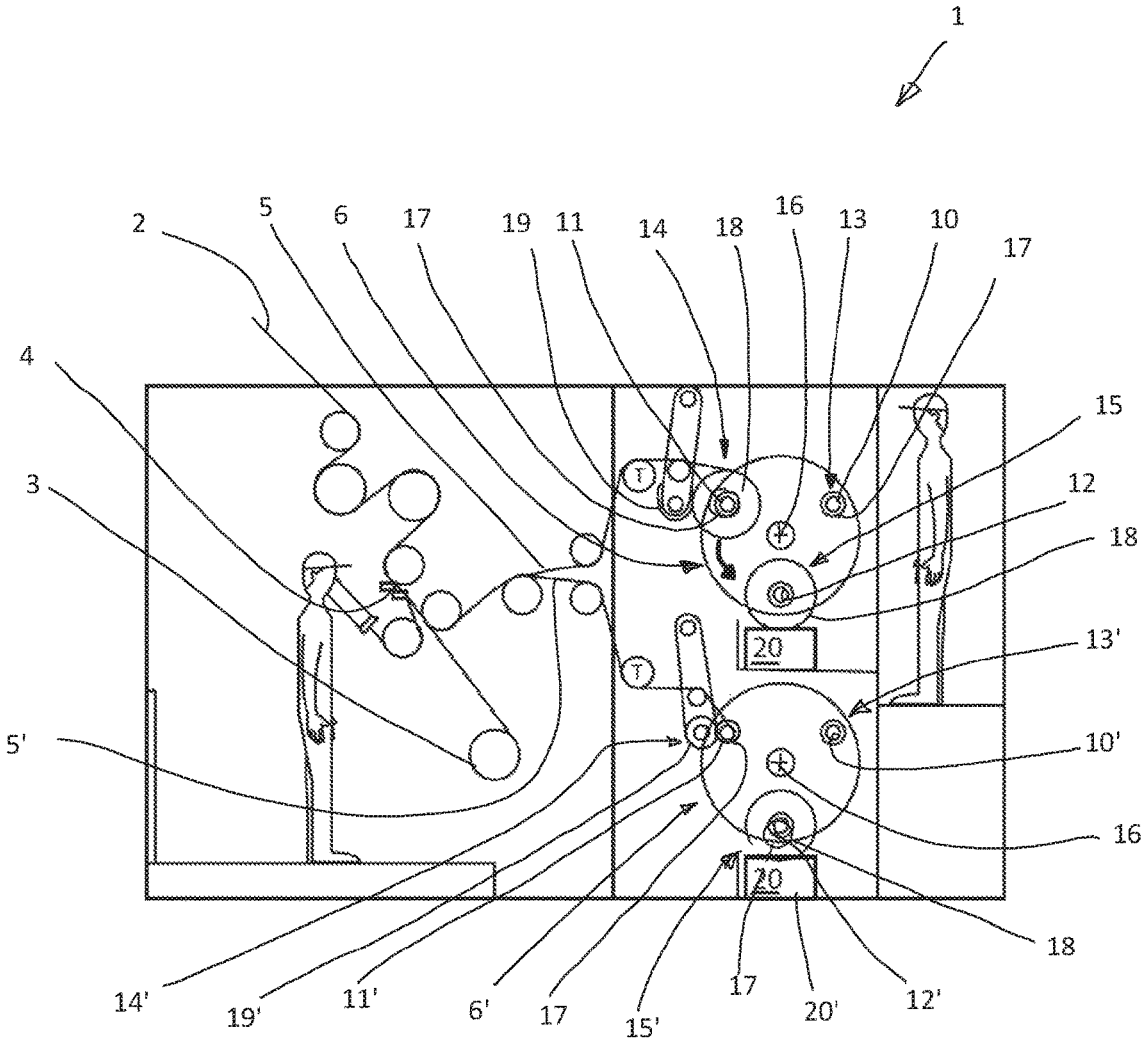

surround the winding shaft (10 to 12, 10' to 12') in the closed position and are pivoted away therefrom in the open position.

23 Claims, 13 Drawing Sheets

(52) U.S. Cl.
CPC ..... *B65H 2301/4148* (2013.01); *B65H 2301/41354* (2013.01); *B65H 2301/41462* (2013.01); *B65H 2301/41726* (2013.01); *B65H 2405/50* (2013.01); *B65H 2408/23155* (2013.01); *B65H 2701/1752* (2013.01)

(58) Field of Classification Search
CPC .... B65H 2301/41354; B65H 2301/418; B65H 2301/41726; B65H 2301/41462; B65H 19/2223; B65H 19/30; B65H 2408/23157; B65H 2405/50; B65H 2701/1752
See application file for complete search history.

(56) References Cited

U.S. PATENT DOCUMENTS 2,769,600 A * 11/1956 Nystrand ..... B65H 19/2223 242/524.1
3,381,911 A * 5/1968 Held ..... B65H 19/223 242/527.3
3,529,785 A * 9/1970 Mistele ..... B65H 19/2215 242/523.1
3,599,892 A * 8/1971 Brouwer ..... B65H 67/02 242/559.2
3,642,221 A * 2/1972 Hellemans ..... B65H 19/28 242/527.4
3,782,665 A * 1/1974 Byrt ..... B65H 19/28 242/527.4
3,871,595 A * 3/1975 Smolderen ..... B65H 19/2215 242/527.4
4,171,780 A * 10/1979 Bugnone ..... B65H 19/2215 242/524.1
4,265,409 A * 5/1981 Cox ..... B65H 19/2223 242/533.5
4,327,876 A * 5/1982 Kuhn ..... B65H 19/2223 242/527.4
4,516,742 A * 5/1985 Townsend ..... B65H 18/04 242/533.5
4,635,871 A * 1/1987 Johnson ..... B65H 75/08 242/574
4,770,358 A * 9/1988 Suzuki ..... B65H 19/26 226/190
5,417,382 A * 5/1995 Petitjean ..... B65H 19/2223 242/527
5,544,828 A * 8/1996 Winkler ..... B65H 67/0405 242/473.5
5,667,162 A * 9/1997 McNeil ..... B65H 18/021 242/533.4
5,725,176 A * 3/1998 Vigneau ..... B65H 19/2223 242/521
5,732,901 A * 3/1998 McNeil ..... B65H 19/2223 242/533.4
5,845,867 A * 12/1998 Hould ..... B65H 19/2223 242/527
5,934,602 A * 8/1999 Jendroska ..... B65H 18/02 242/533.6
6,129,304 A * 10/2000 Biagiotti ..... B26D 3/161 242/530.1
6,270,034 B1 * 8/2001 Kury ..... B65H 19/2215 242/532.2
8,794,562 B2 * 8/2014 Day ..... B65H 19/2223 242/533.4
8,919,687 B2 * 12/2014 Mellin ..... B65H 19/30 242/533.4
8,973,858 B2 * 3/2015 Meyer ..... B65H 18/021 242/533.4
9,045,303 B2 * 6/2015 Singer ..... B65H 18/021
2005/0077416 A1 * 4/2005 Heikaus ..... B65H 19/2207 242/533.4
2005/0127231 A1 * 6/2005 Pasquale ..... B65H 18/26 242/533.6
2006/0137501 A1 * 6/2006 Damo ..... B65H 16/021 83/277
2007/0084958 A1 * 4/2007 Daul ..... B65H 19/2223 242/531
2010/0320307 A1 * 12/2010 Pappas ..... B65H 19/2207 242/525
2013/0092784 A1 * 4/2013 Day ..... B65H 19/2223 242/598.4
2014/0042263 A1 * 2/2014 Singer ..... B65H 18/021 242/576

FOREIGN PATENT DOCUMENTS

GB 2028772 A 3/1980
WO WO-03/010078 A1 2/2003
WO WO-2009/050556 A1 4/2009

* cited by examiner

WINDER AND A TURRET UNIT

The present invention relates to a winder according to the introductory clause of claim 1. Such winders are used predominantly in production lines in which an extruder produces an endless plastic web which is to be wound continuously and without interruption onto winding cores.

A large variety of parameters exist, both with regard to the composition and also with regard to the production speed and the width of the plastic web which is to be wound. In particular the composition entails that the web must be wound under precisely defined conditions: for example, the tension in the wound web and the contact pressure during the winding must be kept precise and depending on the progress in winding in a minimal tolerance range, otherwise the finished roll becomes unusable.

For frequent mass production, including a production with multiple use, where several rolls are wound in groups adjacent to each other on a shared winding shaft, a change on the fly from the finished produced roll to the new winding core is indispensable. Often, a rotatable revolving unit having several winding shafts is used here, which by its rotation brings one of the winding shafts away from its winding position to an unloading position, wherein then at the same time another winding shaft, which is already equipped with one or a group (multiple use) of empty winding cores, arrives into the winding position. During the rotation or immediately after this has been completed, the endless web lane is cut, such that the new, leading end of the web lane winds around the empty winding cores which have just been brought into the winding position, whereby without delay the next group of rolls can be wound.

In other words, the fact is that on one of the winding shafts, which is situated in the winding station, a roll is produced, i.e. web is wound, and on another shaft, in the loading or respectively unloading station, empty winding cores are loaded or respectively the finished rolls are unloaded. A rotation of the revolving unit then brings the winding shafts into the respective next station. The time available for the loading or respectively unloading corresponds substantially to the time required for the providing of one or respectively of a group of rolls, which in turn is predetermined by the feed speed of the web and the required length of the wound web.

Both the feed speed and also the diameter of the rolls have become greater in recent times. Feed speeds of 500 to 600 m/min are the norm, 800 m/min are achievable and even higher feed speeds are to be expected. Roll diameters of up to 400 mm are currently produced; greater diameters are to be expected. The time for the winding of large diameters lies at one minute, where naturally it is desirable to shorten this time.

This has a double significance:

Firstly, the time which is available for the rotation of the revolving unit, which is ultimately unproductive, is extremely short and should amount to no longer than one second. The weight of the finished rolls is considerable, in for example a multiple use with four rolls with a diameter of 400 mm and a width of 500 mm approx. 224 kg. The diameter of the revolving unit, in which such rolls must find a place, becomes increasingly larger with this and exceeds 1 m. The revolving unit becomes a large, solid construction, in which a very high driving power with correspondingly solid driving members becomes necessary for the rotation which is to be carried out in a range of seconds. A reason for this is that for the required roll quality, a precise and stable support of the winding shafts being rotatably supported in the revolving unit for the winding of the rolls is imperative, which in turn presupposes a stable, therefore solid and complex frame of the revolving unit.

Secondly the fact is that a winding shaft which is to be loaded or respectively unloaded must be open on one side, so that on this side winding cores can be pushed on or respectively finished rolls can be drawn off. The support of the winding shafts must therefore be detachable on one side, as is shown for example in WO 2009/050556 with a solution which is also suitable for large rolls. In this solution, however, necessarily all winding shafts, i.e. also those situated in the winding station, are freed on one side, which leads to a considerable stressing of the support on the other side, which is to be counteracted with the corresponding structural input, which in turn makes the revolving unit even more solid.

For winders with small roll diameters, a solution has become known in which a tailstock which is able to be folded away is associated with each winding shaft, which tailstock engages via a retractable pin axially into the front face of the winding shaft and thus supports the latter detachably.

If such a solution were enlarged to scale, a revolving unit would result having a complex and heavy construction, which is undesirable inter alia with regard to the short time available for its rotation. If for example the retractable pin is tapered, it can engage with the equally formed front face of the winding shaft free of play. However, if the pin and the winding shaft are not exactly aligned, which is normal in operation, due to the tapered shape high side forces acting on the tailstock are generated, which in turn leads to the necessity of a solid and complex construction, at least in the case of larger roll diameters. If a cylindrical pin is used to avoid such side forces, already the least tolerance causes wear and out-of-round rotation of the winding shaft, which in turn makes a faultless winding difficult, if not impossible.

Accordingly, it is the object of the present invention to provide an improved revolving unit.

To solve this problem, the revolving unit has the characterizing features of claim 1.

Through the fact that a gripper arrangement with a two-armed scissor unit is provided, even for large roll diameters a compact revolving unit can be realized with correspondingly low inertia on rotation, which with a comparatively simple drive permits high rotational acceleration.

Figure 2:
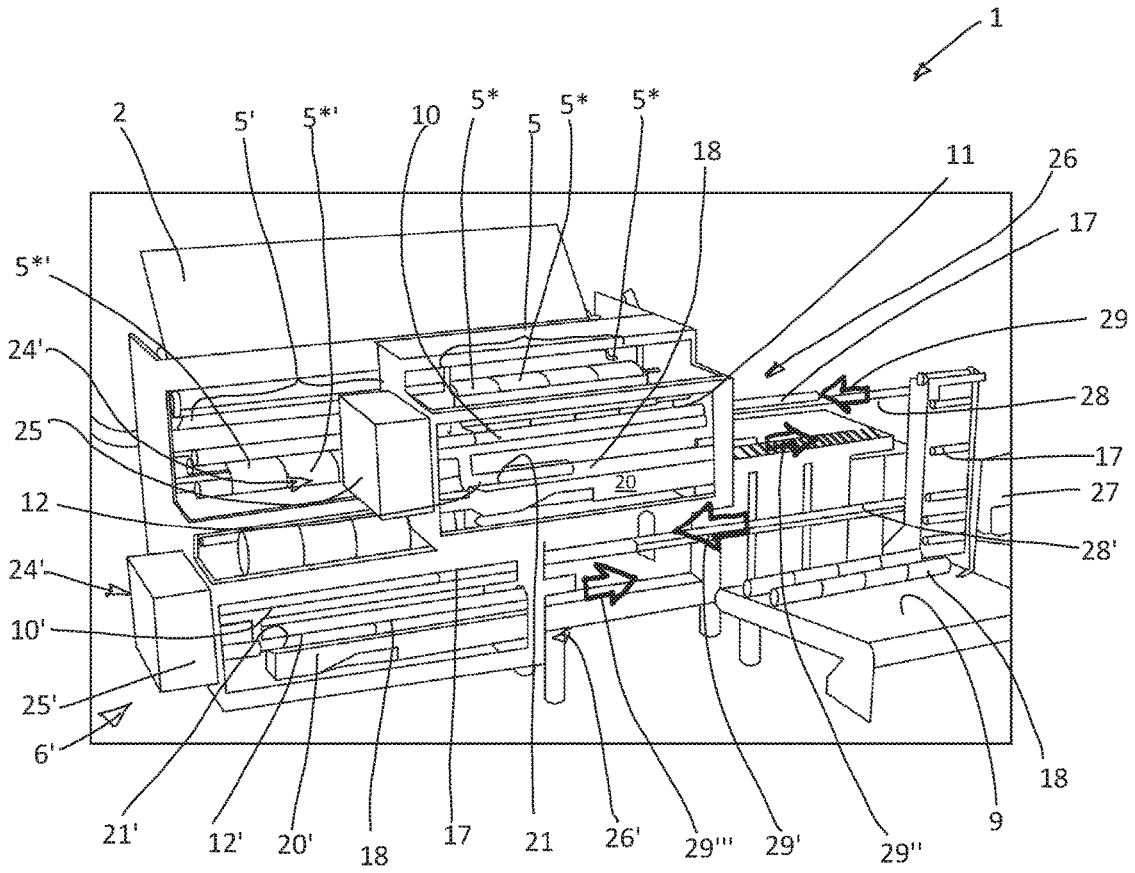
Figure 3:
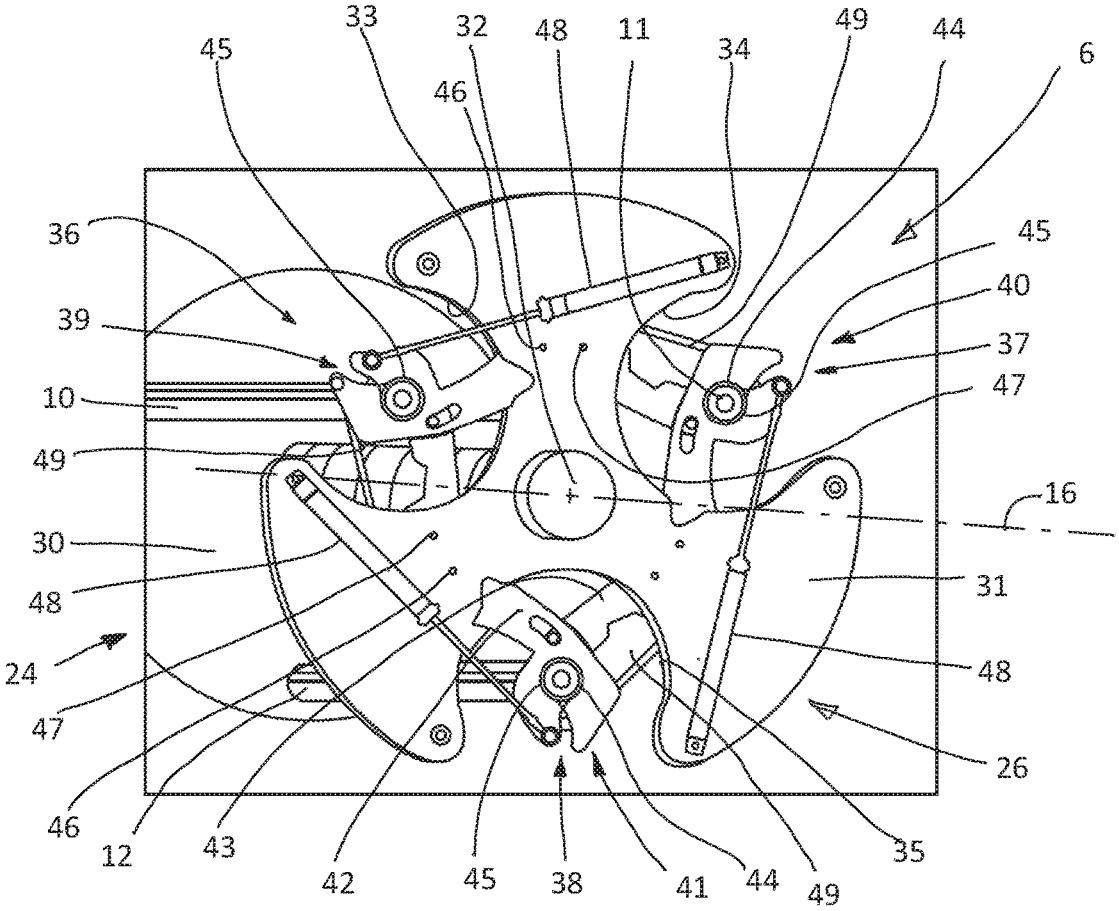
Figure 4A:
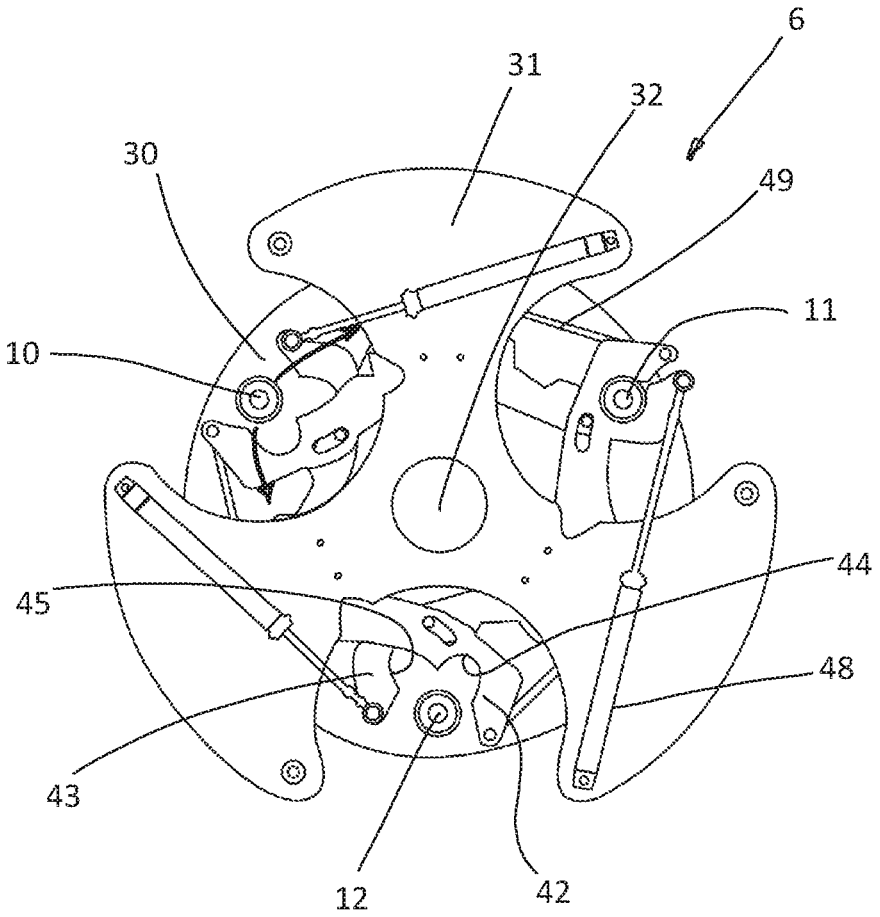
Figure 4B:
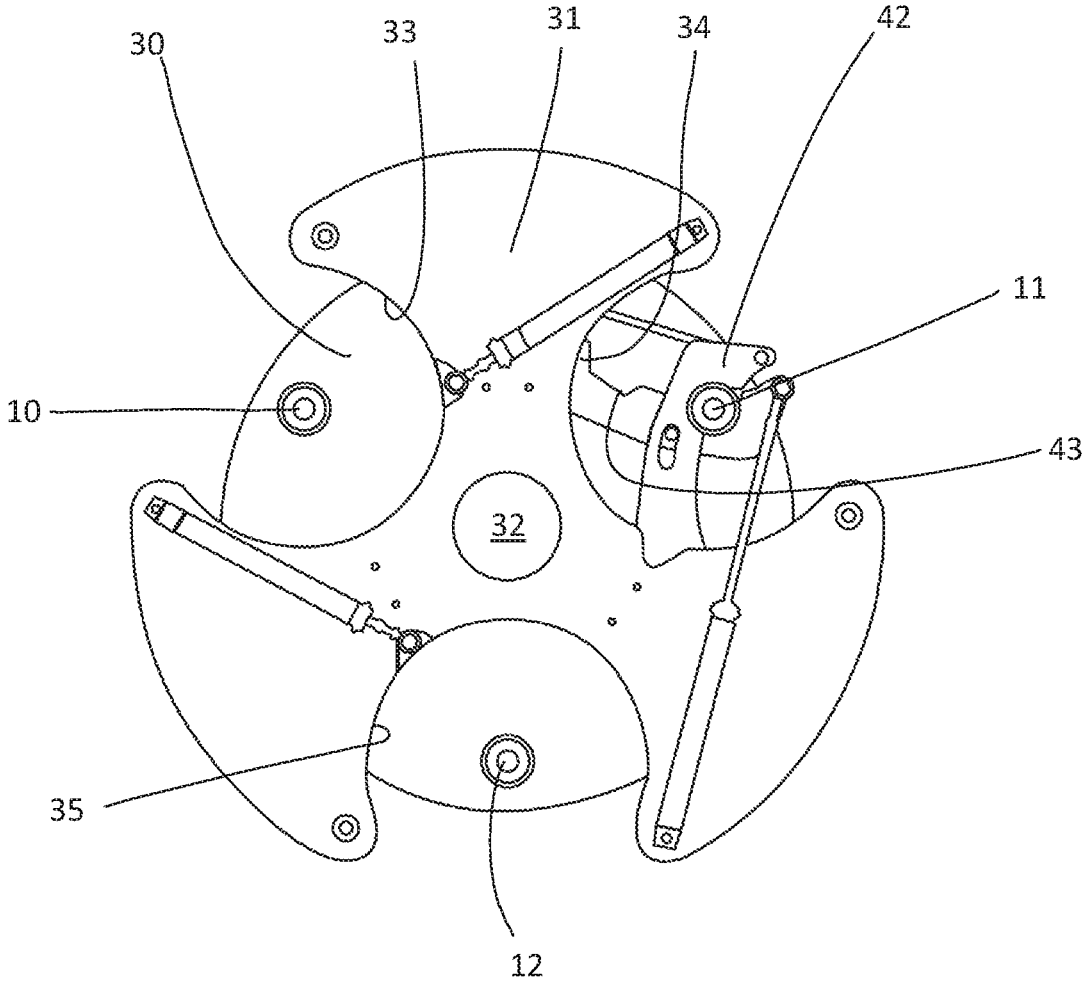
Figure 5:
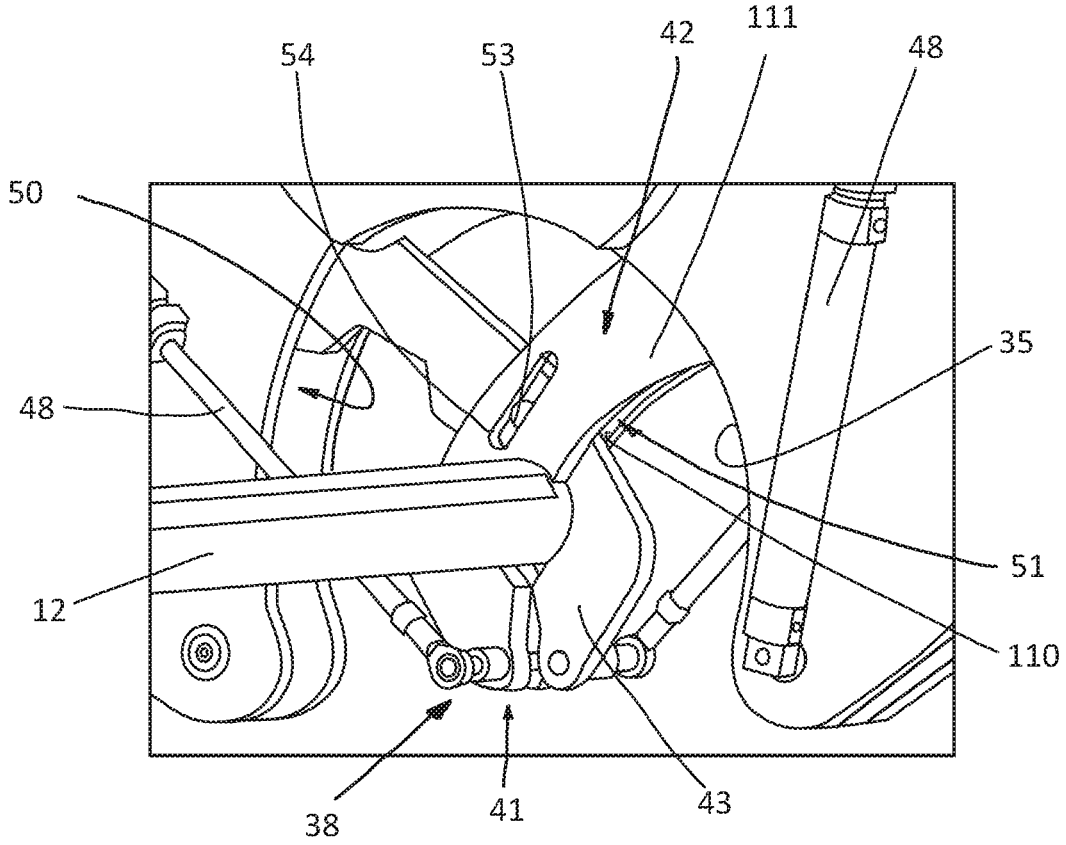
Figure 6A:
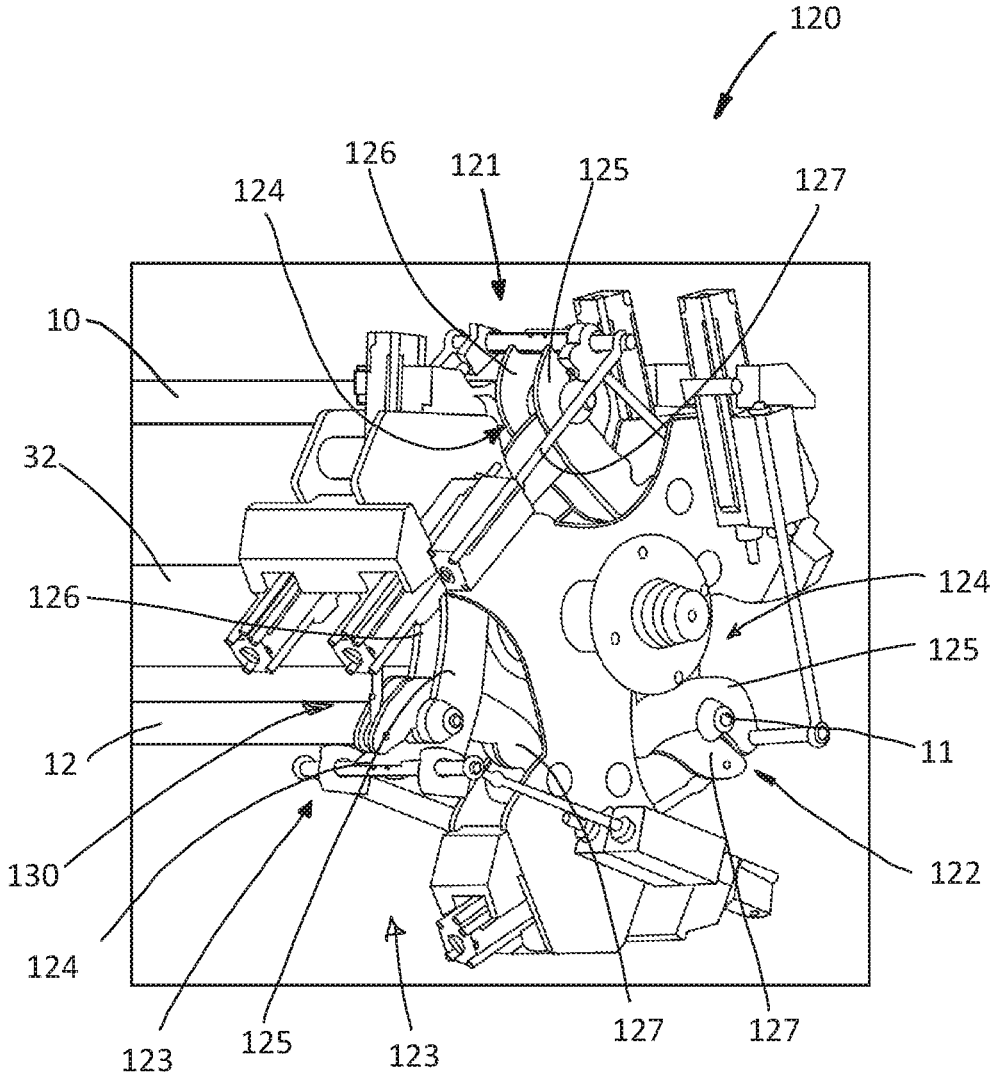
Figure 6B:
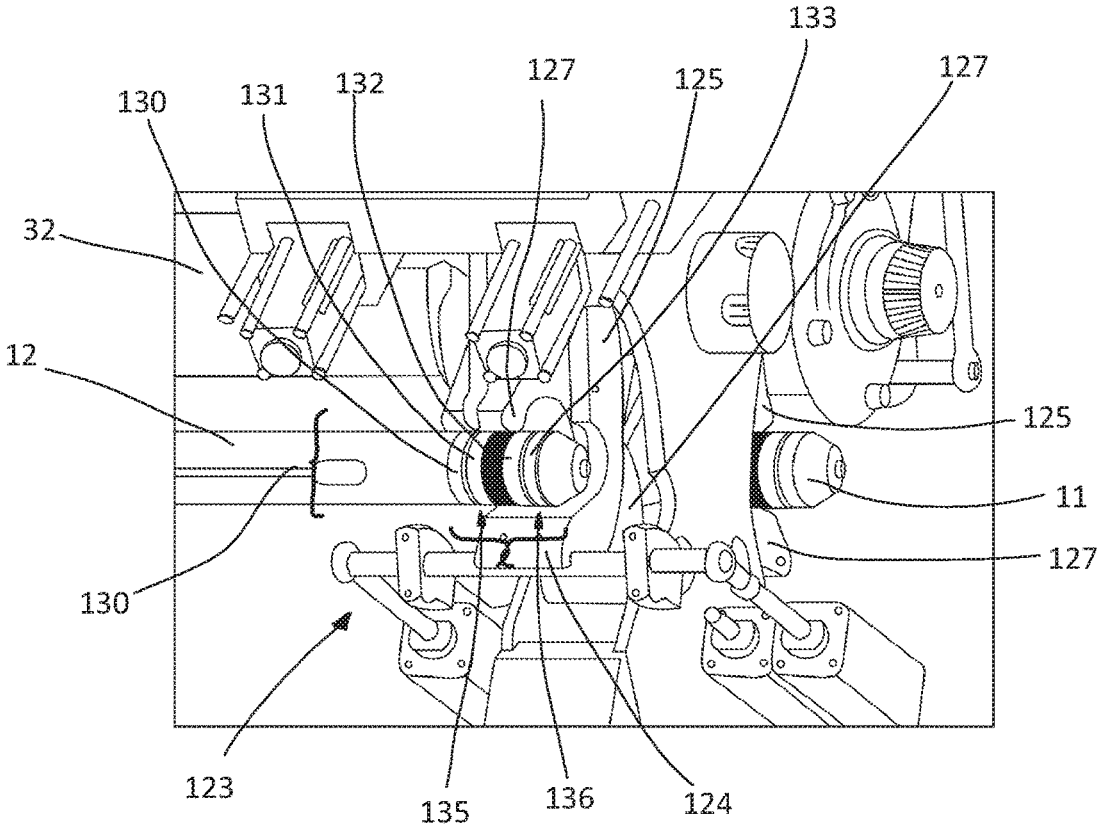
Figure 7:
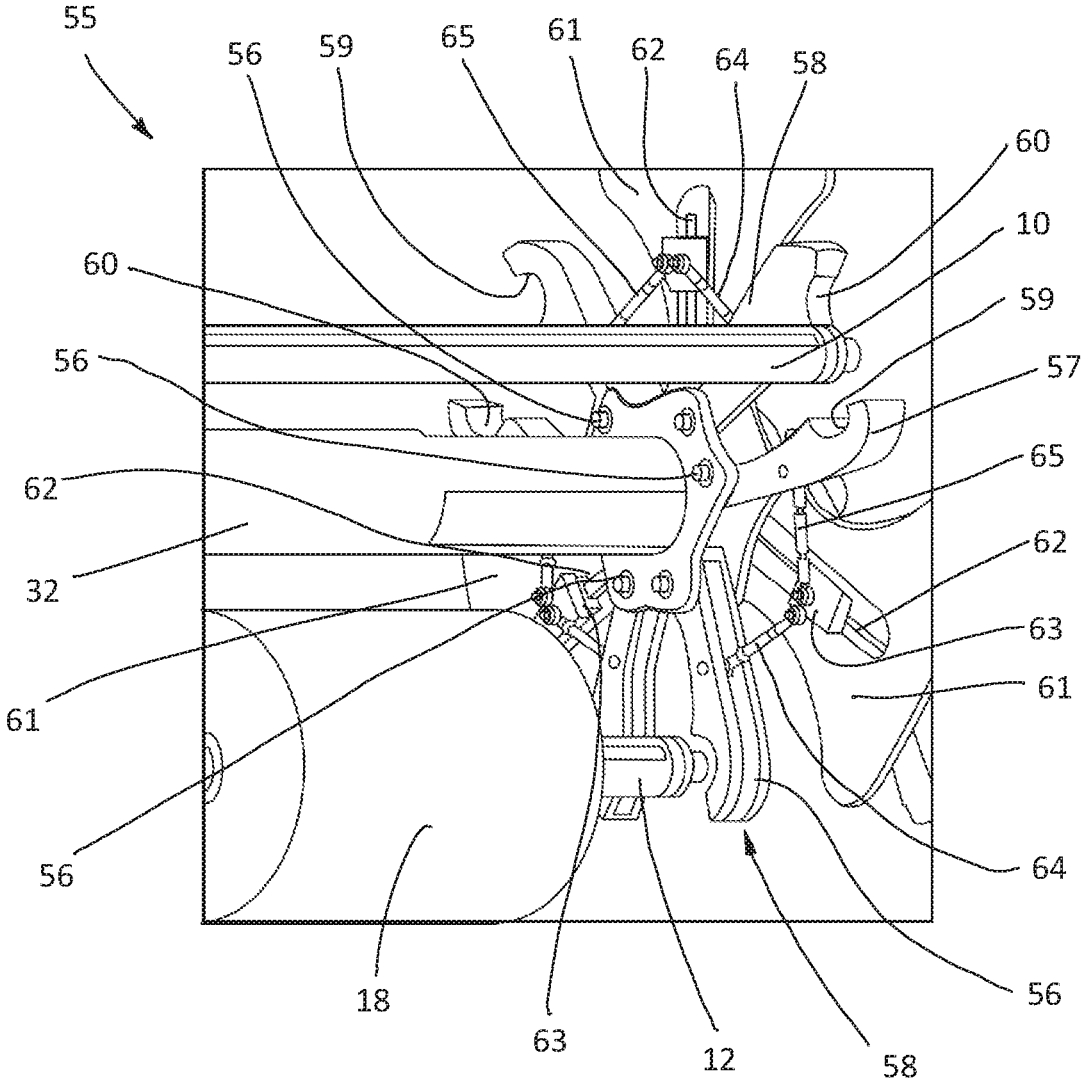
Figure 8:
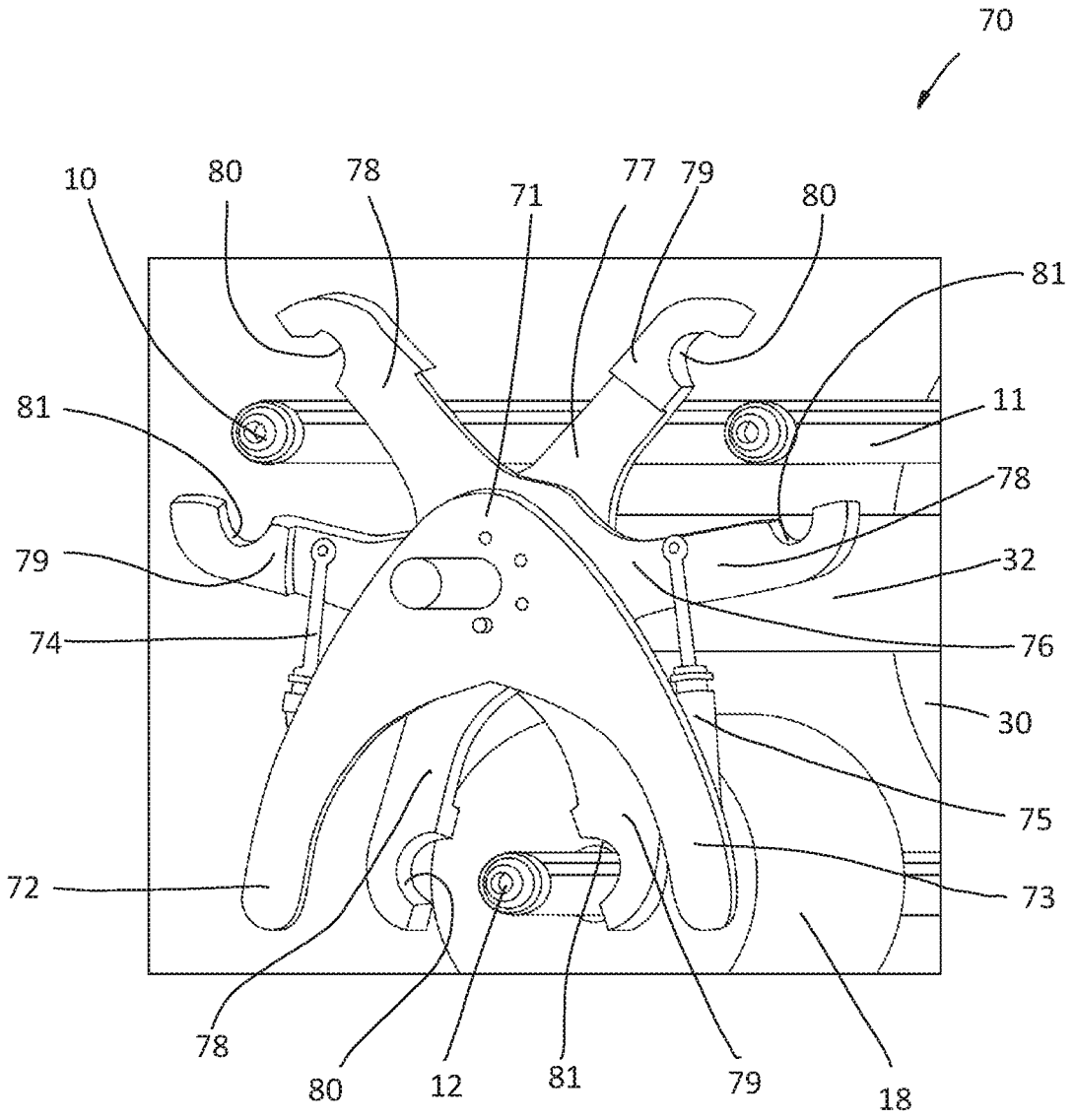
Figure 9A:
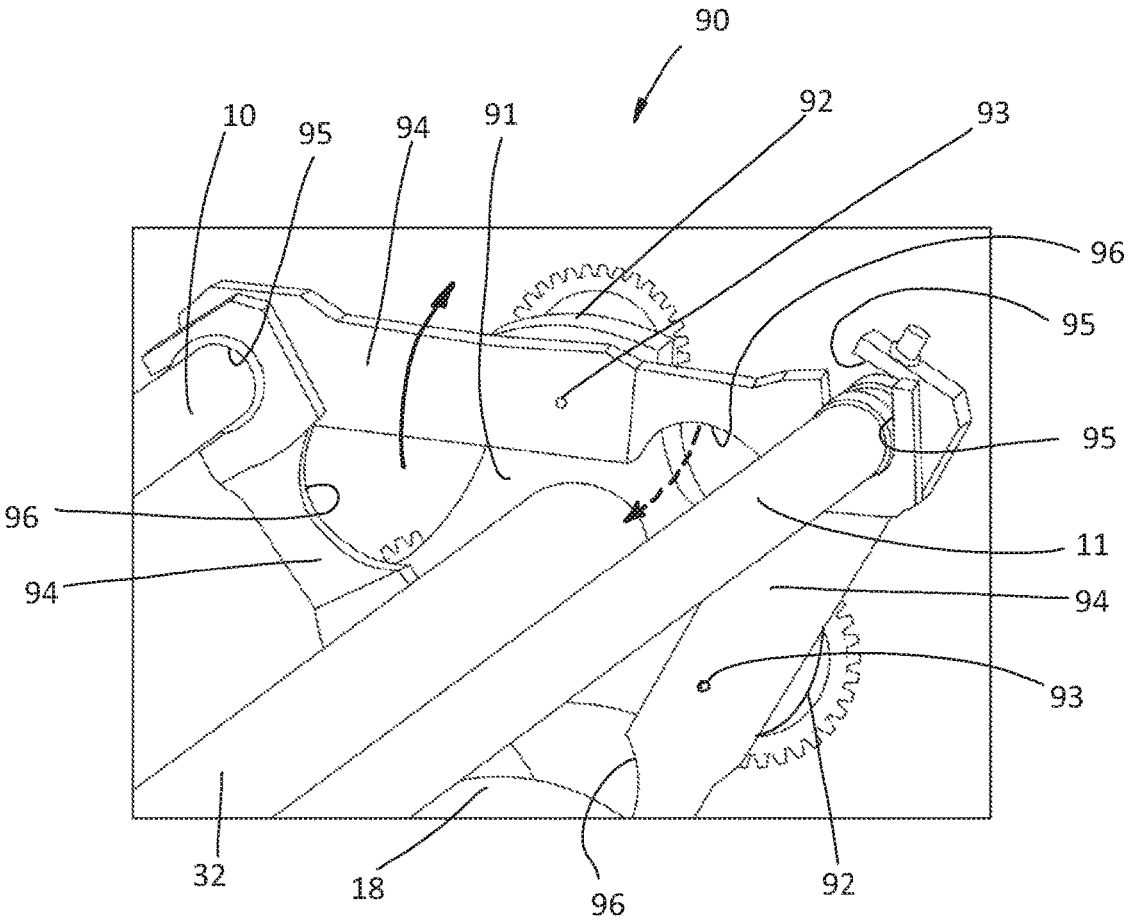
Figure 9B:
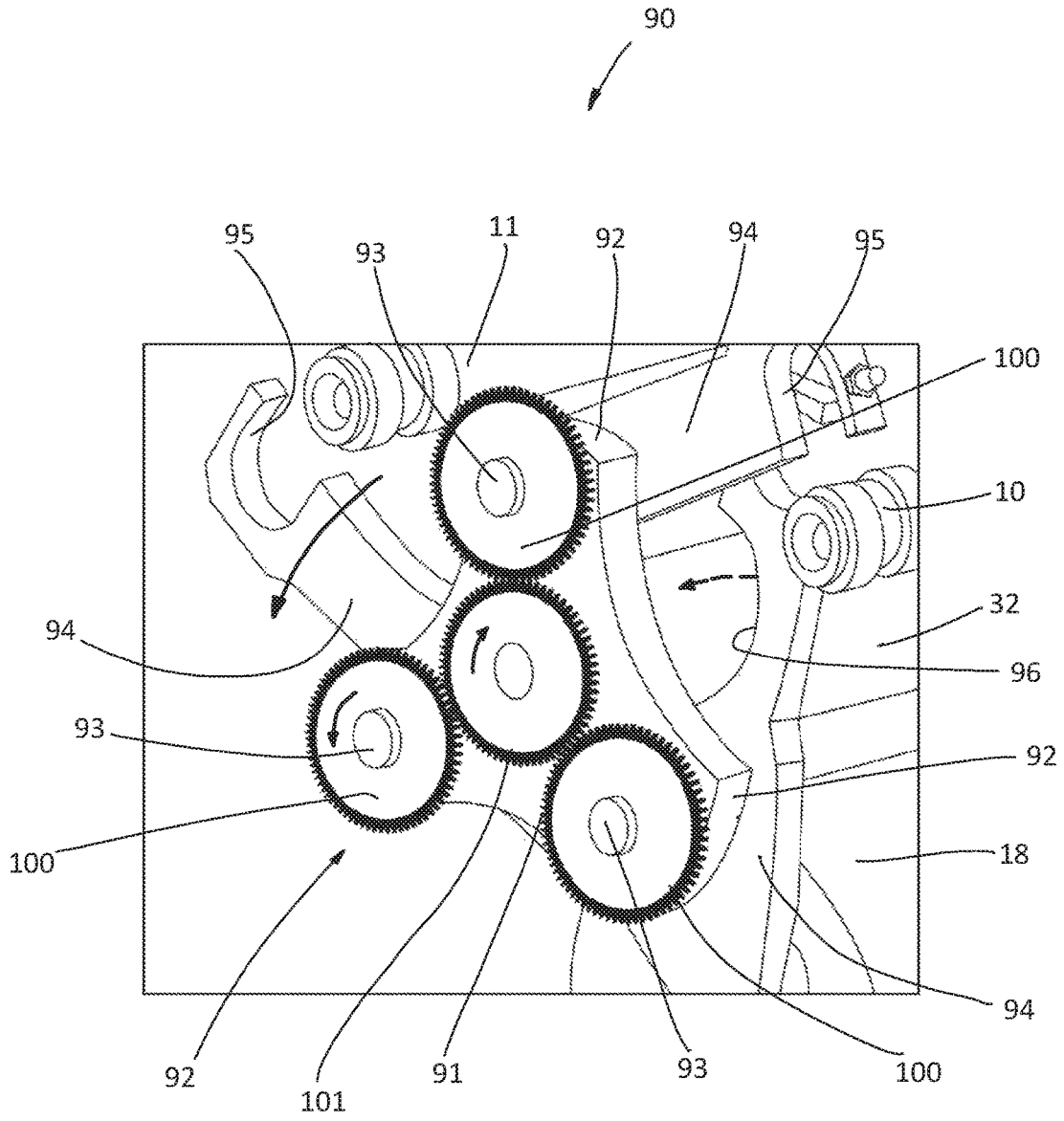
Figure 9C:
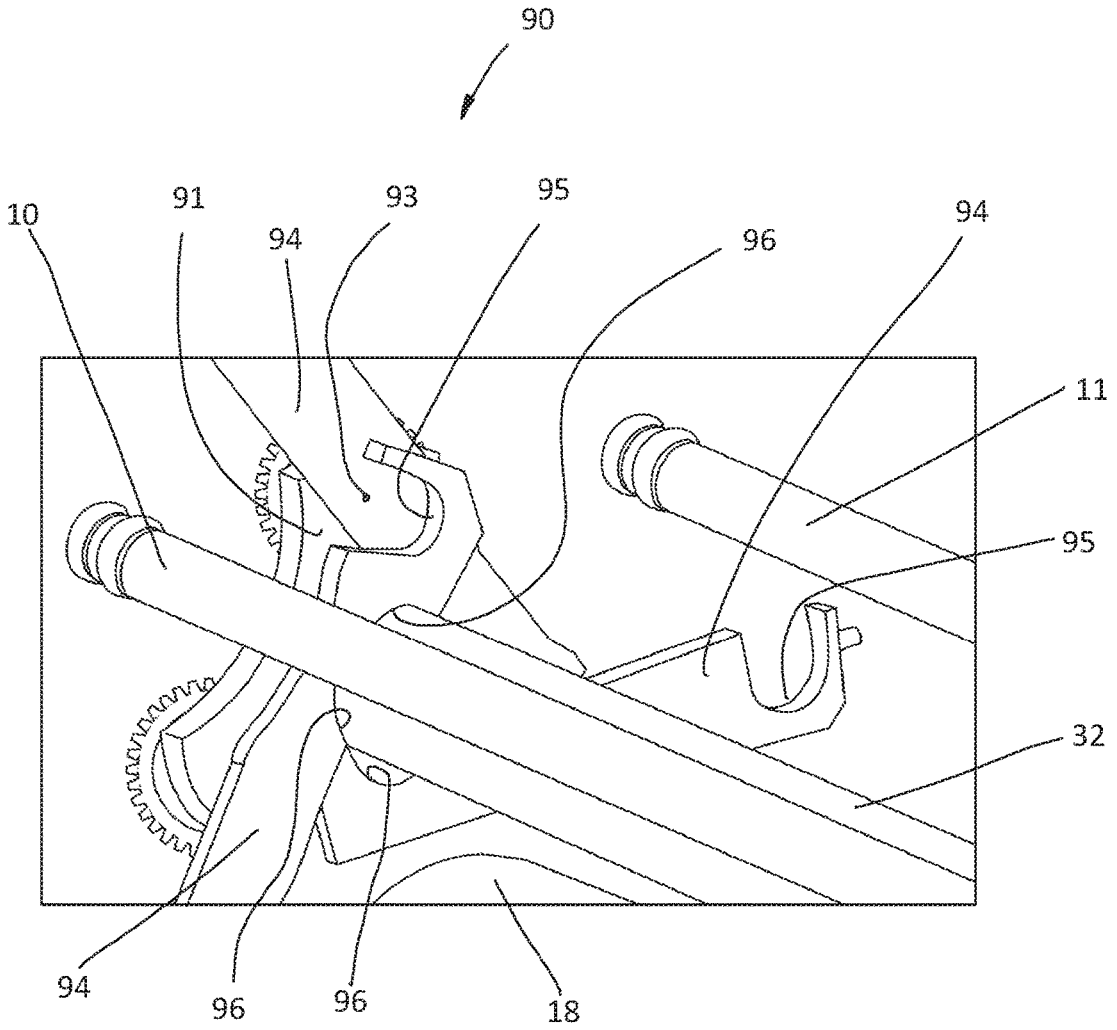

The invention is described in further detail below with the aid of the figures, in which are shown:

FIG. 1 a view from the side of a winder according to the invention with eightfold use, FIG. 2 a three-dimensional view of the winder of FIG. 1 from the front, FIG. 3 a view of a preferred embodiment of the revolving unit according to the invention, FIG. 4*a* a view onto the head end of the revolving unit of FIG. 3, wherein the support of two winding shafts is being released, FIG. 4*b* a view onto the head end of the revolving unit of FIG. 3, wherein the support of two winding shafts is released, whilst the third winding shaft is supported, FIG. 5 a view of the gripper arrangement of the revolving unit of FIG. 3, FIG. 6*a* a view of a further preferred embodiment of a revolving unit according to the present invention, in which the winding shafts are supported along a bearing length, FIG. 6*b* an enlarged view of a gripper unit of the embodiment from FIG. 6*a*, FIG. 7 a view onto the head end of a further embodiment of the revolving unit according to the invention, FIG. 8 a view onto the head end of another further embodiment of the revolving unit according to the invention, and FIGS. 9*a* to 9*c* views onto the head end of an additional embodiment of the revolving unit according to the invention.

FIG. 1 shows a winder 1 according to the invention in a side view, which illustrates the path of the endless lane of a web 2 through the winder 1. A a slitter unit 4 separates the endless web 2 lengthwise, so that two separated web lanes 5 and 5' result, wherein each of the web lanes 5, 5' is guided into an associated revolving unit 6, 6'. The revolving units 6, 6' are basically constructed identically and in the illustrated embodiment have respectively three winding shafts, namely a first winding shaft 10, 10', a second winding shaft 11, 11' and a third winding shaft 12, 12'. Downstream of the slitter unit 4, there is also a separate winding unit 3 for waste web.

The winding shafts 10, 10' to 12, 12' are situated in various work stations, namely a loading station 13, 13', a winding station 14, 14' and an unloading station 15, 15'.

The revolving units 6, 6' are constructed so as to be rotatable by a drive, omitted to clear the figure, in stages about their longitudinal axes 16, 16' anticlockwise in accordance with the drawn arrows, such that each of the winding shafts 10, 10' to 12, 12' during a further rotation stage is brought from its previous into its next work station.

Each of the winding shafts therefore passes in the cycle the loading station 13, 13' where it is loaded with fresh winding cores 17, arrives through a further rotation stage of the revolving units 6, 6' into the winding station 14, 14', where the winding cores 17 are wound with the web 2 to the finished roll 18, and from there into the unloading station 15, 15', where the rolls 18 are unloaded from the revolving unit 6, 6'.

A contact roller 19, 19', known per se to the person skilled in the art, provides in the winding station 14, 14' for the contact pressure corresponding to the respective composition of the web.

To sum up, therefore according to the invention a winder is provided for an endless lane of a plastic web, with a revolving unit, which is constructed so as to be rotatable about its axis and has at least two winding shafts running parallel to its axis, onto which winding cores can be loaded, then wound with the web to a roll, finally unloaded therefrom again as finished rolls, wherein the winding shafts in the revolving unit are securely supported at their one ends in their position parallel to the axis thereof, and wherein the support on the other side is constructed so as to be individually detachable for each winding shaft, such that the respective winding shaft, with released support, can be loaded and unloaded from this end.

Preferably the detachable support for each winding shaft is formed here by a gripper arrangement associated therewith, which is securely arranged on the revolving unit and co-rotates therewith, supports the winding shaft operatively in its closed position and in open position can be moved away therefrom.

The rolls 18 are carried away from the revolving unit 6, 6' via a transport means situated beneath, which is constructed here as a driven conveyor belt 20 situated beneath. The loading station 13, 13' (or respectively the loading position) therefore lies at the 14 o'clock position, the winding station 14, 14' (or respectively the winding position) at the 10 o'clock position and the unloading station 15, 15' (or respectively the unloading position) at the 6 o'clock position.

In the loading station 13, 13' the winding shaft 10, 10' to 12, 12' situated there—in the figure, it is the winding shaft 10, 10'—is loaded with winding cores 17. The winding shaft 10 is already loaded, the winding shaft 10' not yet.

This takes place whilst in the winding station 14, 14' the winding shaft 11, 11' is wound with web 2. The roll 18 of the winding shaft 11 is already advanced, the roll 18 in the winding shaft 11' only carries the first layers of the web 2.

As soon as the rolls 18 are situated in the 6 o'clock position by corresponding rotation of the revolving unit 6, 6', the conveyor surface 21, 21' of the conveyor belt 20, 20' is moved up until it carries the rolls 18 and can carry these away in the direction parallel to the winding shaft 12, 12'. The loss of time between the positioning of the rolls 18 in the unloading station 15, 15' and the start of the conveying away by the conveyor belt 20, 20' is therefore minimal in contrast to the solutions which have become known in the prior art.

In the prior art, the rolls 18 are unloaded at the 10 o'clock—or respectively 14 o'clock—position, with the result that the conveyor belt must be moved from a laterally lying stand-by position firstly under the roll, which in addition costs time. The lateral stand-by position is unavoidable here, because the conveyor belt would otherwise be in the way on rotation of the revolving unit. According to the invention, the conveyor belt 20 is already in position, because in the 6 o'clock position it is not in the way of the rotation of the revolving unit. The loss of time is therefore limited to the short time span which is required for the moving up of the conveyor belt.

According to the invention, a method is thereby produced for the operating of the winder, in which the unloading of the rolls takes place in the region of the 6 o'clock position, wherein preferably on completion of a rotation stage of the revolving unit, by which rolls which are to be unloaded have been brought into the region of the 6 o'clock position, a conveyor means is carried from below up to the rolls, such that they rest thereon with at least a portion of their weight, and are then carried away by this conveyor.

According to the invention therefore in addition a winder is provided for an endless lane of a plastic web, with a revolving unit which is constructed so as to be rotatable about its axis and has at least two winding shafts running parallel to its axis, onto which winding cores can be loaded, then wound with the web to a roll, finally unloaded therefrom again as finished rolls, wherein on both sides of the revolving unit support arrangements are arranged, in which the winding shafts are supported therein at their corresponding ends, and wherein the support for one end of the winding shafts is constructed so as to be detachable, such that the respective winding shaft, with released support, can be loaded and unloaded from this end, wherein the winder is constructed such that a winding shaft respectively can be brought into the region of the 6 o'clock position and the rolls can be unloaded in this region.

FIG. 2 shows a view of the winder 1 of FIG. 1. The web 2 is separated once into the web lanes 5, 5', which in turn are each separated into four longitudinal web lanes 5* or respectively **5*'. Each revolving unit 6, 6' therefore operates with four-fold use, i.e. at the same time four rolls 18** are wound.

At the foot end 24, 24' of the revolving units 6, 6', a driving unit 25, 25' is situated for, on the one hand, the gradual rotation of the revolving unit itself and, on the other hand, for the rotation of the winding shafts 10, 10' to 12, 12' which is necessary in the winding station 14, 14' (FIG. 1). The head end 26, 26' of the revolving units 6, 6' is free, in order to enable the loading of the winding shafts 10, 10' with winding cores 17 and the unloading of rolls 18 from the winding shafts 12, 12'.

The loading with winding cores 17 and the unloading of the rolls 18 takes place in the direction of the longitudinal axis of the respective winding shaft 10, 10' to 12, 12'.

Illustrated in addition are a magazine 27 for winding cores 17 with a buffer rod 28, from which the provided group of winding cores 17 can be pushed in the direction of the arrow 29, 29' onto a winding shaft 10, 10' to 12, 12', as soon as it has reached its loading position. The rolls 18 dispensed from the conveyor belts 20, 20' arrive in the direction of the arrow 29", 29'" into an output area 9.

As mentioned above, in the present layout the loading of a winding shaft 10, 10' to 12, 12' with winding cores presupposes that the winding shaft is freely accessible at the head end 26, 26' of the revolving unit, i.e. is not supported there. Likewise for the unloading of rolls 18. This means that the respective winding shaft 10, 10' to 12, 12' is then only supported on one side in the foot end 24, 24', i.e. projects therefrom, which in turn makes necessary a complex and solid support at the foot end 24, 24'. This is less critical in the loading station 13, 13', because the winding cores 17 are comparatively light, but it is critical in the unloading station 15, 15' with the heavy rolls 18 in the case of larger diameters.

In the winding station 14, 14', on the other hand, the respective winding shaft 10, 10' to 12, 12' must be supported on both sides, because otherwise, due to the winding tension and the contact pressure roller 19, the winding shaft could not run smoothly and, in addition, would bend out, which would make an efficient winding impossible in the case of most compositions.

Accordingly, it is necessary to support the winding shafts 10, 10' to 12, 12' at both ends at least in the winding station 14, 14', but not in the other stations, i.e. to construct the support for one end of the winding shafts 10, 10' to 12, 12' so as to be detachable, and in so doing to configure the support so as to be correspondingly rigid at the end which is always securely fixed.

If the support at the one end of the winding shaft 10, 10' to 12, 12' in the unloading station 15, 15' is now only released according to the invention when the conveyor belt 20, after moving up, carries the rolls 18, the requirements for the support are in fact not completely, but nevertheless considerably, reduced in the other end of the winding shaft which is fixed securely at the foot end 24, 24' of the revolving unit 6, 6'. The unloading of the rolls 18 in the 6 o'clock position accordingly leads not only to a saving of time in the unloading area, but also at the same time to reduced requirements for the support of the winding shafts.

FIG. 3 shows diagrammatically a view of a preferred embodiment of a revolving unit 6 according to the invention (for simplicity, the reference number 6' and all numbers with a ' belonging to the revolving unit 6' are omitted).

At the foot end 24, a base plate 30 is situated, which is disc-shaped here, in which the winding shafts 10 to 12 are arranged. Concealed by the base plate 30, i.e. on its rear side, the driving unit 25 (FIG. 2) is arranged with the driving components for the rotation of the winding shafts 10 to 12 and the rotation of the revolving unit 6 itself. To clear the figure, all the surrounding elements of the revolving unit 6 (see FIG. 2) and their support are omitted.

At the head side 26 a mounting plate 31 is situated, securely arranged on a central tube 32 which lies in the longitudinal axis 16 of the revolving unit 6 and is fixed on the base plate 30, so that the mounting plate 31 co-rotates with the base plate 30. Recesses 33 to 35 are provided at the site of the winding shafts 10 to 12 and have dimensions which permit a free passage of winding cores 17 to be loaded onto the winding shaft associated therewith, or of finished rolls 18 to be unloaded therefrom.

On the mounting plate 31, three support arrangements for the winding shafts 10 to 12 are arranged, each with a gripper arrangement 36 to 38, which in turn each have a two-armed scissor unit 39 to 41.

Each scissor unit 39 to 41 is provided with two scissor arms 42, 43, which in the closed position each engage via a recess 44, 45 on the winding shaft associated therewith, and thus support this operatively. The scissor arms 42, 43 are supported on pivot points 46, 47 in the mounting plate 31 and are able to be pivoted here via pneumatic cylinders 48, 49, whereby the scissor units 39 to 41 can be opened and closed.

In the illustrated arrangement, the mounting plate 31 extends outwards from the axis 16 of the revolving unit 6 radially between adjacent winding shafts 10 to 12, wherein the scissor arms 44, 45 of the gripper arrangement 36 to 38 are articulated on the mounting plate 31 pivotably in a region lying between the winding shafts 10 to 12.

In the embodiment which is shown, three winding shafts 10 to 12 and a mounting plate 31, having the contour of a three-armed star, are provided, wherein three gripper arrangements 36 to 38, constructed as scissor units 39 to 41, are arranged on the mounting plate 31, the scissor arms 42, 43 of which, pivotably arranged on the mounting plate 31, are opened and closed via driving units, preferably pneumatic cylinders 48, 49, arranged on the mounting plate 31.

FIG. 4*a* shows the revolving unit 6 in a phase in which the support arrangements of the winding shafts 10 and 12 are opened (loading of winding cores 17 onto the winding shaft 10/unloading of rolls 18 from the winding shaft 12), whilst that of the winding shaft 11 is closed, because the latter is situated in the winding station 14 (FIG. 1).

The scissor arms 42, 43 are pivoted for this in the direction of the arrows which are drawn. In this respect, it is to be noted that the support arrangements can basically be operated independently of each other and also during the rotation of the revolving unit 6.

For example, it is possible that, in contrast to the movement phase of the support arrangements shown in the figure, the one in the 6 o'clock position (unloading station 15, FIG. 1) remains closed, until the conveyor belt 20 carries the rolls 18 (FIG. 1), whilst that of the loading station opens still during the rotation of the revolving unit 6 or immediately thereafter.

FIG. 4*b* shows the revolving unit 6 in a phase in which new winding cores 17 are loaded and the rolls 18 are unloaded: the support arrangements of the winding shafts 10 and 12 are completely open, the scissor arms 42, 43 are situated in the open position, i.e. pivoted away from the winding shafts, and are sunk in the mounting plate 31, so that the passage for the rolls 18 is only limited by the dimensions of the recesses 33 to 35.

By the articulation of the scissor arms 42, 43 in a region between adjacent winding shafts 10 to 12, a position is produced in their open position, which permits only a small distance of the recess 33 to 35 (to be kept completely free in the open position) from the central tube 32, so that the winding shafts 10 to 12 can be moved close thereto and thereby the revolving unit 6 can be configured so as to be compact as a whole. In addition, this articulation of the scissor arms 42, 43 allows the recess 44 in the arm 42 to be configured so that the supported winding shaft 10 to 12 is supported in the winding station 14 (FIG. 1) by the latter, i.e. the stress acting there is not able to open the scissor unit 39 to 41.

FIG. 5 shows a view of the recess 35 of the mounting plate 31 with the gripper arrangement 38, consisting of the scissor unit 41 (of course, the two other recesses 33, 34 are constructed identically with the members arranged therein). It can be seen here that the mounting plate 31 is constructed as a double plate, in the cavity 50 of which the scissor arms 42, 43 are able to be sunk. Likewise, it can be seen that the scissor arm 42 is also constructed with double walls, having an outer wall (110) and an inner wall (111), and wherein another scissor arm (43,42) is located in between the outer wall (110) and the inner wall (111). The outer wall (110) and the inner wall (111) form a cavity 51 which receives the scissor arm 43, which is thereby guided. In addition, a cam follower 54, arranged on the scissor arm 43, running in a cam track 53 of the scissor arm 42, and thereby improves the safety and the coordinated movement of the scissor arms 42, 43.

FIG. 6*a* shows a further preferred embodiment of the revolving unit 120 according to the present invention. Two winding shafts 10 and 12 can be seen, whilst the third winding shaft 11 (FIG. 5) is hidden. Furthermore, the gripper arrangements 121 to 123 are shown, having double-walled scissor arms 124, consisting of an outer wall 125 (i.e. lying towards the outer side of the revolving unit 120) and an inner wall 126 (lying inside the revolving unit 120). Located in between the outer wall 125 and the inner wall 126 is an associated scissor arm 127. The scissor arms 124,127 of each of the gripper arrangements 121 to 123 are in closing position, embrace the respective winding shaft 10 to 12 and form for these a bearing unit 130 bearing the respective winding shaft 10 to 12 over a bearing length l, as shown in more detail in FIG. 6*b*.

FIG. 6*b* shows a detailed view of the gripper unit 123, which is shown shortly before its closing position, and thus still exposes the view of the end of the winding shaft 12.

The following description relates to the elements of the gripper unit 123, but is correspondingly valid also for the other gripper units 121 and 122 (including their winding shafts 10 and 11) of the revolving unit 120 (FIG. 6*a*):

Shown is the outer wall 125 of the scissor arm 124, whilst its inner wall 126 (FIG. 6*a*) is hidden. Also shown is the scissor arm 127, lying in between the outer wall 125 and the (hidden) inner wall 126. The thickness of the scissor arm 127 is determined by the person skilled in the art according to the following conditions.

The winding shaft 12 has four bearings 130 to 133, i.e. a first bearing 130, a second bearing 131, a third bearing 132 and a fourth bearing 133, which are preferably made as roller bearings, but can be constructed by the person skilled in the art in any manner with regard to the specific winder. In the closing position of the scissor arms 124,127, the first bearing 130 cooperates with the inner wall 125 of the scissor arm 124 (FIG. 6*a*), the second bearing 131 and the third bearing 132 cooperate with the scissor arm 127 and the third bearing cooperates with the outer wall 125 of the scissor arm 124. In other words, it is the case that the first bearing 130 and the second bearing 131 form a first bearing area 135 and the third bearing 132 and the fourth bearing 133 form a second bearing area 136 for the winding shaft 12, the distance between which corresponds to the bearing length l.

A support having a bearing length l brings about an improved bearing by means of fixed clamping of the winding shaft 12, since the clamping extends over a length section of the winding shaft 12 which has an advantageous effect on the line of deflection under the stress acting in the winding station, for example, with a view to. the resonance frequency (vibrations during winding) or with a view to equal pressure over the width of all of the rolls by the contact roller 19,19' (FIG. 1). In particular for large diameters of the rolls at high winding speeds the parameters resonance frequency and uniform pressure are decisive for faultless winding.

Accordingly, the person skilled in the art can determine the bearing length l according to the two said parameters and also according to other relevant parameters and, for example, in the arrangement shown in the figures, therefore also the width of the scissor arm 127 which determines the distance of the outer wall 125 from the inner wall 124 (FIG. 6*a*). It is included within the inventive idea to construct the scissor arm disposed between the outer wall 125 and the inner wall 124 likewise with double walls in order to prevent said scissor arm 124 (FIG. 6*a*) becoming too solid.

In principle, the scissor arms can be configured to be of arbitrary width so that for each specific application the bearing length l can be realized optimally. This includes the fact that the scissors are configured in the bearing area as required by the person skilled in the art, i.e. in such a manner that they support and thereby clamp the winding shaft over the bearing length at one or at several points.

The preferred embodiment of the present invention illustrated in FIGS. 1 to 6 has three winding shafts, with the advantage that on a respective winding shaft only winding cores can be loaded or respectively rolls can be unloaded. According to the invention, however, there are also revolving arrangements with only two winding shafts, wherein then during the production of the rolls on the one winding shaft, on the other winding shaft on the one hand, the rolls have to be unloaded and on the other hand, the new winding cores have to be loaded. In addition, configurations with more than three winding shafts are conceivable. In addition, in the embodiments illustrated in FIGS. 2 to 5, the rolls are unloaded and the winding cores are loaded on the same side. If the winder according to FIG. 2 has the layout illustrated there, this is advantageous, because the driving unit can be arranged on the other side. Such a layout is not, however, compulsory. Embodiments according to the invention also allow winding cores to be loaded from one side and the rolls to be dispensed on the other side. The mounting plates according to the invention are then to be provided on both sides, which permits complete flexibility in the layout of the winder. In other words: the detachably supported ends of the winding shafts can also lie on different sides of the revolving unit.

Finally, according to the preferred embodiment illustrated in FIGS. 2 to 5, the winding shafts are fixed at the foot end 24, 24' (FIG. 2). According to another further embodiment, likewise according to the invention, the winding shafts can also be arranged detachably at the foot end, for example by a mounting plate equipped with gripper arrangements, as is already used at the head end of the revolving unit. Thereby, winding shafts can be unloaded from the revolving unit in radial direction and inserted therein again, which allows winding shafts to be loaded with winding cores outside the revolving unit, or respectively allows the rolls to be unloaded from the winding shaft outside the revolving unit.

FIG. 6 shows a view onto the head end of a further embodiment of the revolving unit 55 according to the invention. The winding shafts 10 and 12 can be seen, and also the central tube 32, with the winding shaft 11 being concealed by the winding shaft 10.

Instead of a mounting plate 31 (FIGS. 2 to 4), a double flange ring 52 is provided, on which scissor arms 57, 58, pivotable via pivoting axes 56, are articulated, which extend radially away substantially from the region of the axis 16 of the revolving unit and which in the closed position support via recesses 59, 60 the respective winding shaft 10 to 12, but free it in the open position.

A three-armed guide plate 60 here has in each of its arms 61 a guide rail 62, running radially therein, for a driving element 63, which pivots the scissor arms 57, 58 via driving arms 64, 65. The displacement of the driving element 63 takes place via a conventional drive provided on the rear side of the arms 61 of the guide plate 60, such as e.g. a threaded spindle, as is familiar to the person skilled in the art.

FIG. 7 shows a view onto the head end of another further embodiment of the revolving unit 70 according to the invention, with the winding shafts 10 to 12, wherein on the central tube 32 an anchor plate 71 is fixed, with base arms 72, 73, which form between them a passage for a roll 18 which is to be unloaded, and support pneumatic cylinders 74, 75 which each act on a three-armed support star 76, 77. By the actuation of the cylinders 74, 75, the support stars 76, 77 rotate with their arms 78, 79 towards each other or away from each other, so that a winding shaft 10 to 12 lying between the arms is supported in the recesses 80, 81 or is freed.

FIGS. 8*a* to 8*c* show three views from a different viewing direction onto the head end of an additional embodiment of the revolving unit 90 according to the invention.

FIG. 8*a* shows a support plate 91, securely arranged on the front face of the central tube 32, corotating therewith, with radially projecting, short appendices 92, which extend into the space between the winding shafts 10 to 12 (i.e. leave space free for the unloading of a roll 18) and in the outer region serve as support for a rotation axis 93, via which in turn in each case a locking arm 94 is rotatably supported about its centre.

In the illustrated configuration, the winding shafts 10 to 12 form the corners of an equilateral triangle, wherein the rotation axes 93 lie in the centre of the triangle sides. The length of the locking arms 94 is selected such that these surround the winding shafts on the end side with their support grooves 95 in the manner of scissors and can lock them in their position, i.e. support these operatively in the closed position.

The support is released by the locking arms being turned clockwise corresponding to the arrow which is drawn, so far until the recess 96, corresponding in its contour to the central tube 32, lies against it (and the passage for rolls 18 is open), as is indicated by the dotted arrow.

FIG. 8*b* shows the drive of the locking arms via cogwheels 100, which in turn are driven via a central cogwheel 101. This arrangement has the advantage that the cogwheel 101 can be driven via a shaft running in the central tube 32 and hence the corresponding motor can be housed in the driving unit 25 (FIG. 2), which assists the compact construction of the illustrated revolving unit 90.

FIG. 8*c* shows the locking arms 94 in open position and the winding shafts 10, 11 projecting freely therewith, with the open passage for rolls 18 or respectively winding cores 17.

Further embodiments can be constructed with bearing arrangements according to FIGS. 6 to 8, as is illustrated above for the further embodiments for a revolving unit according to FIGS. 2 to 5.

The invention claimed is:

1. A winder for an endless lane of a plastic web, the winder comprising:

a revolving unit, which revolving unit is constructed so as to be rotatable about an axis of the revolving unit and has at least two winding shafts running parallel to the axis, onto which winding shafts winding cores can be loaded, then, the winding cores being loaded onto the winding shafts, the winding cores are wound with the web to a roll, finally unloaded therefrom again as finished rolls;

wherein, on both ends of the revolving unit, support arrangements are arranged, in which the winding shafts are supported at their corresponding ends therein;

wherein the support arrangements at least for one end of the winding shafts is constructed so as to be detachable, such that the respective winding shaft, with released support, can be loaded and unloaded with the finished rolls in a direction parallel to the winding shafts from this end; and wherein the detachably constructed support arrangements each have a gripper arrangement with a two-armed scissor unit, the scissor arms of the two-armed scissor unit surround the winding shafts in a closed position and are both pivoted away therefrom in an open position.

2. The winder according to claim 1, wherein the support arrangements for the end, which is to be freed, of a respective winding shaft are detachable independently of each other.

3. The winder according to claim 1, wherein the revolving unit has a mounting plate, arranged perpendicular to the axis of the revolving unit and fixed to the revolving unit, for the gripper arrangement, with dimensions of the mounting plate being such as to permit a free passage of winding cores to be loaded onto the winding shaft associated therewith, or of finished rolls to be unloaded therefrom.

4. The winder according to claim 3, wherein the mounting plate extends outwards from the axis of the revolving unit radially between adjacent winding shafts and the scissor arms of the gripper arrangement are articulated pivotably on the mounting plate in a region lying between adjacent winding shafts.

5. The winder according to claim 4, wherein three winding shafts and the mounting plate having a contour of a three-armed star are provided, and wherein, on the mounting plate, three gripper arrangements, constructed as scissor units are arranged, the scissor arms of which, arranged pivotably on the mounting plate, are opened and closed via driving units likewise arranged on the mounting plate.

6. The winder according to claim 2, wherein the scissor arms are articulated pivotably in a region of the axis of the revolving unit thereon and extend radially away therefrom.

7. The winder according to claim 1, in which the revolving unit is rotatable such that the winding shafts for loading with winding cores, for the winding of a roll and for unloading of a finished roll lie at a respectively associated position, wherein an unloading position lies in a region of a 6 o'clock position.

8. The winder according to claim 7, wherein under the revolving unit beneath the unloading position, conveyor means are provided for the unloading of the rolls from the winding shaft.

9. The winder according to claim 1, wherein the scissor arms in the closed position form a bearing unit bearing an associated winding shaft over a bearing length.

10. The winder according to claim 9, wherein the bearing unit bears its associated winding shaft at two areas spaced from each other, and wherein a distance between said two areas is the bearing length.

11. The winder according to claim 1, wherein one of the scissor arms of the gripper arrangements is constructed with double walls, having an outer wall and an inner wall, and wherein another scissor arm is located in between the outer wall and the inner wall.

12. The winder according to claim 11, wherein in the closed position of the scissor arms the inner wall operatively cooperates with the other scissor arm and forms a first bearing area and in the same manner, the outer wall operatively cooperates with the other scissor arm and forms a second bearing area.

13. A revolving unit comprising:

at least two winding shafts running parallel to an axis of the revolving unit, onto which winding cores can be loaded, then the winding cores being on the winding shafts, the winding cores are wound with a web to a roll, finally unloaded therefrom again as finished rolls;

wherein on both ends of the revolving unit, support arrangements are arranged, in which the winding shafts are rotatably supported at their corresponding ends therein;

wherein the support for at least one end of the winding shafts is constructed so as to be detachable, such that the respective winding shaft, with released support, can be loaded and unloaded with the finished rolls in a direction parallel to the winding shafts from this end; and wherein the detachably constructed support arrangements each have a gripper arrangement with a two-armed scissor unit being securely arranged on the revolving unit, both of the scissor arms of which are pivotably supported on the revolving unit, surround the winding shaft in the closed position and are both pivoted away therefrom in the open position.

14. The revolving unit according to claim 5, wherein the mounting plate extends outwards from the axis of the revolving unit radially between adjacent winding shafts, and the scissor arms of the gripper arrangement are articulated pivotably on the mounting plate in a region lying between the winding shafts.

15. The revolving unit according to claim 13, wherein the scissor arms in the closed position form a bearing unit bearing the associated winding shaft over a bearing length.

16. The revolving unit according to claim 15, wherein the bearing unit bears its associated winding shaft at two areas spaced from each other, and whereby the distance between said two areas forms the bearing length.

17. A method for operating a winder according to claim 1 wherein unloading of the rolls takes place in a region of a vertically lowermost 6 o'clock position.

18. The method for operating a winder according to claim 7, wherein when rolls which are to be unloaded have been brought into the region of the 6 o'clock position, a conveyor is brought from below up to the rolls, such that they rest with at least a portion of their weight thereon, before they are carried away by this conveyor.

19. A winder for an endless lane of a plastic web, the winder comprising:

a revolving unit, which revolving unit is constructed so as to be rotatable about an axis of the revolving unit that is parallel to the ground and has at least two winding shafts running parallel to the axis, onto which winding shafts winding cores can be loaded in a direction parallel to the winding shaft, then, the winding core being loaded onto the winding shafts, then wound with the web to a roll, finally unloaded therefrom again in a direction parallel to the winding shaft, wherein on both ends of the revolving unit, support arrangements are arranged, in which the winding shafts are supported at their corresponding ends therein wherein the support for at least one end of the winding shafts is constructed so as to be detachable, such that the respective winding shaft, with released support, can be loaded or unloaded from this end; and wherein the winder is constructed such that respectively one winding shaft can be brought into a region of a vertically lowermost 6 o'clock position towards the ground and the rolls can be unloaded in this region in a direction parallel to the winding shaft.

20. The winder according to claim 19, wherein under the revolving unit, conveyor means are arranged, which are vertically displaceable relative to the ground and which in a vertically lower position of rest permits free rotation of the revolving unit, equipped with finished rolls, and which in a vertically upper conveying position carries at least a portion of a weight of the unloaded rolls which are to be unloaded.

21. The winder according to claim 1, wherein each of the scissor arms of the scissor unit is pivotably supported on the revolving unit, and both of the scissor arms are synchronously pivoted away from their closed position.

22. The winder according to claim 6, wherein pivot points for each of the scissor arms of the scissor unit are positioned adjacently to each other and the scissor arms extend in a closed position side by side away from the axis of the revolving unit.

23. The winder according to claim 19, wherein under the revolving unit, conveyor means are arranged in a position of rest so as to permit free rotation of the revolving unit, equipped with finished rolls, and which in a conveying position carries at least a portion of a weight of the unloaded rolls which are to be unloaded, whereby the conveyor means being adapted to convey rolls to be unloaded in a direction parallel to the winding shafts.

* * * * *